United States Patent [19]

Shimizu

[11] Patent Number: 4,792,416

[45] Date of Patent: Dec. 20, 1988

[54] SUBSTANCE AND PROCESS FOR CONVERTING WASTE COOKING OIL INTO LIQUID SOAP

[75] Inventor: Kazuo Shimizu, Kasukabe, Japan

[73] Assignee: Mimasu Oil Chemical Co., Ltd., Tokyo, Japan

[21] Appl. No.: 56,772

[22] Filed: Jun. 2, 1987

[30] Foreign Application Priority Data

Dec. 29, 1986 [JP] Japan ..... 61-310121

[51] Int. Cl.[4] ..... C11D 13/00; C11D 9/30; C11D 17/08

[52] U.S. Cl. ..... 252/369; 252/117; 252/121; 252/367; 252/368; 252/547; 252/548; 252/DIG. 14

[58] Field of Search ..... 252/117, 548, 110, DIG. 14, 252/367, 368, 369, 370, 121, 547

[56] References Cited

U.S. PATENT DOCUMENTS

| | | | |
|---|---|---|---|
| 4,053,314 | 10/1977 | Kimura | 96/49 |
| 4,436,643 | 3/1984 | Bürger | 252/135 |
| 4,595,527 | 6/1986 | Gipp | 252/546 |

FOREIGN PATENT DOCUMENTS

| | | |
|---|---|---|
| 0009500 | 1/1986 | Japan . |
| 1215035 | 12/1970 | United Kingdom . |
| 1479611 | 7/1977 | United Kingdom . |

*Primary Examiner*—Paul Lieberman
*Assistant Examiner*—Kathleen Markowski
*Attorney, Agent, or Firm*—Wegner & Bretschneider

[57] ABSTRACT

The substance of the present invention which contains an amine derivative such as alkanol amine, alkyl amine and alkylene amine and a surface-active agent is capable of converting waste cooking oil into useful liquid soap easily and quickly. The substance contains a minimum amount of or no strong alkali substances and is therefore quite safe for home use. Thus, waste cooking oil may be recycled for useful purposes and contamination of sewage with waste cooking oil can be prevented.

7 Claims, No Drawings

SUBSTANCE AND PROCESS FOR CONVERTING WASTE COOKING OIL INTO LIQUID SOAP

TECHNICAL FIELD

The present invention relates to a substance for processing waste cooking oil (which may include oil and fat from either vegetable or animal sources) and in particular to a substance which allows waste cooking oil to be converted into liquid soap or detergent (including substances which may be considered to be soap in terms of chemical structure but which would not be considered to be soap in terms of such physical properties as appearance, consistency, etc.) so that the waste cooking oil can thereby be recycled for reuse safely and easily.

BACKGROUND OF THE INVENTION

In the methods of processing waste cooking oil proposed in Japanese patent laid open publications Nos. 60-44597 and 59-81398, waste cooking oil is absorbed into inorganic non water soluble substances such as activated clay, montmorillonite, sepiolite, bentonite, calcite, attapulgite, clay and so on and is then filtered for reuse. According to other known methods of processing waste cooking oil, enzyme may be applied to the waste cooking oil, or the waste cooking oil may be chemically reduced or absorbed into fibril media such as paper, non-woven fabric, rayon fibers and so on.

Japanese patent laid open publication No. 55-105298 discloses a method in which waste cooking oil is solidified by means of a certain higher fatty acid to form a gel which can be readily disposed of.

In the above mentioned prior art methods of processing waste cooking oil, since the waste cooking oil is either recycled in a form which may not be suitable for human consumption or is simply discarded, it cannot be fully utilized. There is therefore a demand for a method or a substance which will allow waste cooking oil to be recycled in the form of a reuseable substance.

It has been known previously that soap can be produced as a result of a (saponification) reaction between alkali metal hydroxide such as sodium hydroxide, potassium hydroxide, ammonium hydroxide, etc. or sodium orthosilicate (as proposed in Japanese patent laid open publication No. 61-116000), which is also highly alkaline, and animal fat or vegetable oil. However, such strong alkaline chemical compounds are not suitable for use at home. Alkali metal hydroxide is highly reactive with carbon dioxide and humidity in the air and could be dangerous because the reactions are often extremely violent.

BRIEF SUMMARY OF THE PRESENT INVENTION

In view of such problems of the prior art, a primary object of the present invention is to provide a substance which is capable of producing mild liquid soap from waste cooking oil which can be conveniently used for various washing purposes. In this way, not only can the waste cooking oil be reused as soap and an economic advantage obtained but also contamination of sewage with waste cooking oil can be prevented. In addition, allowing the user to produce soap from waste cooking oil will serve a beneficial educational purpose.

A second object of the present invention is to provide a substance for producing mild liquid soap from waste cooking oil which can eliminate peroxides from waste cooking oil in order to prevent the formation of unpleasant odorous substances.

A third object of the present invention is to provide a substance for producing mild liquid soap which is free from highly alkaline substances and is therefore safe to handle.

These and other objects of the present invention can be accomplished by providing a substance for converting waste cooking oil into liquid soap, comprising: an amine derivative and a surface-active agent; the PH value of the resulting substance being adjusted to 10 or higher. Typically, the amine derivative is a combination selected from a group including alkanol amine, alkyl ($C_2$ to $C_{18}$) amine and alkylene ($C_2$ to $C_8$) amine.

Alkanol amine soap has previously been known but it is necessary to saponify fatty acid at high temperature over a long period for formation of alkanol amine soap. On the other hand, with the substance of the present invention which is prepared by controlling the PH level and the composition, waste cooking oil which is a glycerin ester of fatty acids can be converted into mild liquid soap easily and quickly (within several tens of minutes). The obtained liquid soap, after being diluted with water, can be conveniently employed for laundry use, house cleaning, polishing furniture, dish washing and bath use.

Acoording to a certain aspect of the present invention, the substance of the present invention further comprises alkali metal salt and/or alkali hydroxide, and the content of the amine derivative is greater than 50% while the content of the surface-active agent is from 0.5% to 30%.

According to another aspect of the present invention, the surface-active agent is a combination selected from a group including anonic agents such as LAS (linear alkylbenzenesulfonate), AOS (alpha-olefinsulfonate), SAS (alkylsulfonate, AES (alkylethersulfateester), AS (alkylsulfateester), FS (alkali metal - higher fatty acid salt, or soap, in particular potassium or ammonium - alkanol amine salt), ZAS (salcosine salt) and SUS (alkylsulfosuccinate); nonionic surface-active agents such as polyoxyethylene compounds (such as polyoxyethylenealkylether, polyoxyethylenealkylphenolether, polyoxyethylenealkylate, polyoxyethylene-fatty acid-alkanol amide, etc.), fatty acid esters (sonbitanalkylate, fatty acid alkanol amide, glycerolalkylate, ethyleneglycolalkylate, etc.), alkyl phosphate esters, alkyl amine oxides, etc.; and neutral surface-active agents such as alkyl betaine, imidazoline and glycin-alkyl amine betaine.

When liquid soap is to be produced from, for instance, 100 grams of waste cooking oil, 20 to 50 grams of the substance of the present invention is added to the waste cooking oil and water of the same quantity (20 to 50 grams) is added thereto as required. The mixture is stirred and heated in a container made of stainless steel, steel, ceramic material, glass or alloy. The mixture then rapidly undergoes chemical reactions and turns into a yellow or orange substance in several tens of minutes. The final substance is the liquid soap.

DESCRIPTION OF THE PREFERRED EMBODIMENTS

Examples of the liquid soap produced with the substance of the present invention are described in the following. T,0070 T,0080 T,0090 T,0091

The substance of the present invention includes an amine derivative in an amount of at least 50% and a surface active-agent in an amount of 0.5% to 30% and its PH value is adjusted to 10 or higher by addition of alkali metal salt and/or alkali metal hydroxide. The substance of the present invention can be employed for laundry use, dish washing, house cleaning and bath use after being diluted with water three to five times in terms of volume.

The substances which can be used as the amine derivative of the present invention include alkanol amine (such as monoethanol amine, diethanol amine, triethanol amine, monoisopropanol amine and triisopropanol amine), alkyl amine (such as ethyl amine, stearyl amine, oleyl amine, polyoxyethylene palmitolein amine and lauryl amine), alkylene amine (such as ethylene diamine, diethylene triamine, propylene diamine, triethylene tetramine, aminoethyl piperazine, pentaethylene hexamine and piperazine), morpholin, hydrazine, hydroxy hydrazine, etc. In particular, alkanol (such as triethyl and diethyl) amine is preferred because of its safety, stability, smell and economy. The content of the amine derivative is preferably in the range of from 20 wt % to 98 wt % and is usually approximately 50 wt %. The content of the amine derivative should be adjsuted according to the content of the surface-active agent.

The substances which can be used as the surface-active agent of the present invention include anonic agents such as LAS (linear alkyl benzenesulfonate), AOS (alpha-olefinsulfonate), SAS (alkylsulfonate), AES (alkylethersulfateester), AS (alkylsulfateester), FS (alkali metal - higer fatty acid salt, or soap, in particular potassium or ammonium - alkanol amine salt), ZAS (salcosine salt), SUS (alkylsulfosuccinate), etc. The nonionic surface-active agents which can be used as the surface-active agent for the substance of the present invention include polyoxyethylene compounds (such as polyoxyethylenealkylether, polyoxyethylenealkylphenolether, polyoxyethylenealkylate, polyoxyethylene-fatty acid-alkanol amide, etc.), fatty acid esters (sorbitanalkylate, fatty acid alkanol amide, glycerolalkylate, ethyleneglycolalkylate, etc.), alkylphosphate esters, alkyl amine oxides, etc. Neutral surface-active agents such as alkyl betaine, imidazoline and glycin-alkyl amine betaine compounds can also be used.

In particular, anionic surface-active agents such as potassium or ammonium - alkanol amine salt are most preferred because of their stability in water solution and their commerial availability. Nonionic surface-active agents such as polyoxyethyleneether compounds and amine oxide compounds are also preferred because of their stability in alkaline environment and the freedom with which they can be mixed.

The content of the surface-active agent can be freely selected but should be preferably in the range from 0.5% to 50%. The content of the surface-active agent should be adjusted depending on the nature of the waste cooking oil that is to be processed so that the saponification, suds formation and alkalinity control will be satisfactory. When the surface-active agent content exceeds 50%, this can be compensated for either by increasing the alkalinity of the substance of the present invention or by using a greater amount of the substance of the present invention with a given amount of waste cooking oil, but the stability of the substance may be impaired and the economic benefits may suffer.

In addition to the amine derivative and the surface-active agent, the substance of the present invention may include alkali metal salt and/or alkali hydroxide which serves as an agent for raising the PH value of the substance to 10 or higher, stabilizing the alkaline contents and improving the washing performance of the produced soap.

The alkali metal salt may be any of the following substances; potassium bicarbonate, potassium carbonate, sodium carbonate, potassium silicate, potassium orthosilicate, potassium metasilicate, potassium pyrophosphate, potassium tertiary phosphate, potassium hexametaphosphate, potassium citrate, ammonium citrate, potassium malate, ammonium malate, ammonium oxalate, potassium oxalate, potassium maleate, ammonium maleate, potassium tartrate, ammonium tartrate, Rochelle salt, ammonium phytate, potassium phytate, ammonium glycolate, tetrasodium ethylenediamine tetraacetate, tetrapotassium ethylenediamine tetraacetate, potassium nitrile triacetate, etc.

The alkali metal hydroxide may be potassium hydroxide, ammonium hydroxide, sodium hydroxide, lithium hydroxide, or a combination thereof, and potassium hydroxide is most preferred.

The following is a typical composition of the substance of the present invention:

amine derivative: 20 to 90 wt %
surface-active agent: 0.5 to 30 wt %
other balancing agents: balance It is necessary for the PH value of the substance to be 10 or higher (preferably in the range from 10 to 13.5) for the purpose of achieving satisfactory saponification and formation of a safe salt by causing thorough reaction between glyceride and peroxide of the waste cooking oil and water. If the PH value is lower than 10, saponification will be insufficient and the object of the present invention will not be satisfactorily achieved. The content of sodium hydroxide and ammonium hydroxide in the above mentioned balancing agents is desired to be less than 5% for safety in handling.

Optional components which may be added to the substance of the present invention include dispersing agents (such as urea, sodium xylenesulfonate, potassium cumenesulfonate, ethyleneglycol, lower alcohols, glycolether, ethyleneurea, etc.), anti-oxidization agents (such as BHT, tocopherol, lipoid, etc.), perfume bases and vegetable essences for masking oil odor (such as limonene, terpenoid, alpha-pinene, etc.), water-soluble colloid (colloidal silica, colloidal alumina, colloidal sulfur, etc.), deodorizing and sterilizing agents (such as sodium hypochlorite, chlorine dioxide, sodium bromite, etc.), and coloring agents (dyes, pigments, fluorescent agents, etc.), etc.

The substance of the present invention may have different levels of consistency and may be in the form of a liquid, a paste or semi-solid. However, the liquid state is preferred because of its convenience in handling.

Thus, according to the present invention, liquid soap can be made from waste cooking oil safely and easily as a result of a mild alkaline chemical reaction. Therefore, not only can the contamination of sewage with waste cooking oil be prevented but also economic advantages can be obtained through conversion of waste material into useable soap. Furthermore, since the obtained soap is more or less liquidous, it is easier to handle than solid soap and its level of concentration can be adjusted by adding water thereto in a desired amount for different soap applications.

What I claim is:

1. A process for converting waste cooking oil to detergent, comprising contacting a waste cooking oil with a composition comprising greater than 50% of an amine derivative, from 0.5 to 30% of a surface active agent, an alkali metal salt and/or an alkali hydroxide, wherein the pH of the composition is adjusted to 10 or higher and adding water in amounts sufficient to form a liquid detergent.

2. A process for converting waste cooking oil into liquid soap as defined in claim 1, wherein the amine derivative is a compound selected from the group consisting of alkanolamine, alkyl ($C_2$ to $C_{18}$) amine and alkylene ($C_2$ to $C_8$) amine.

3. A process for converting waste cooking oil as defined in claim 2, wherein the alkanolamine is ethanolamine and/or isopropanolamine.

4. A process for converting waste cooking oil into liquid soap as defined in claim 3, wherein the surface-active agent is a compound selected from the group consisting of anionic agents, nonionic agents, and neutral agents.

5. A process for converting waste cooking oil into liquid soap as defined in claim 4, wherein the anionic surface-active agent is selected from the group consisting of linear alkyl benzenesulfonate, alpha-olefinsulfonate, alkylsulfonate, alkylethersulfate ester, alkylsulfate ester, alkali metal-higher fatty acid salt or soap, salcosine salt, and alkylsulfosuccinate.

6. A process for converting waste cooking oil into liquid soap as defined in claim 4, wherein the nonionic surface-active agent is selected from the group consisting of polyoxyethylene compounds, fatty acid esters, alkylphosphate esters, alkyl amine oxides.

7. A process for converting waste cooking oil into liquid soap as defined in claim 4, wherein the neural surface-active agent is selected from the group consisting of alkyl betaine, imidazoline and glycin-alkyl amine betaine.

* * * * *